United States Patent [19]

Wolf

[11] 4,165,581

[45] Aug. 28, 1979

[54] SOUND CONTROLLED VEHICLE

[76] Inventor: Tobin Wolf, 285 Aycrigg Ave., Passaic, N.J. 07055

[21] Appl. No.: 841,701

[22] Filed: Oct. 13, 1977

Related U.S. Application Data

[63] Continuation-in-part of Ser. No. 735,998, Oct. 27, 1976, abandoned.

[51] Int. Cl.[2] ..... A63H 29/22

[52] U.S. Cl. ..... 46/256; 46/263

[58] Field of Search ..... 46/252, 256, 263

[56] References Cited

U.S. PATENT DOCUMENTS

| | | | |
|---|---|---|---|
| 2,921,408 | 1/1956 | Leblic | 46/256 |
| 2,974,441 | 3/1961 | Denner | 46/256 |
| 2,995,866 | 8/1961 | Johnson | 46/256 |
| 3,383,794 | 5/1968 | Ruth | 46/252 |
| 3,961,441 | 6/1976 | Sato | 46/256 |

*Primary Examiner*—Louis G. Mancene
*Assistant Examiner*—Robert F. Cutting
*Attorney, Agent, or Firm*—Jay M. Cantor

[57] ABSTRACT

The disclosure relates to a toy vehicle which is capable of movement in the forward direction and is capable of left and/or right turns by means of a remote sound or radio frequency, transmitted to a controlled mechanism in the vehicle for performing the turning function. The turning function is accomplished by means of a linkage system as well as a motor driven disc with electrically conductive pattern thereon for providing the vehicle control.

In accordance with a second, third and fourth embodiment of the invention, the turning function is provided in conjunction with a reversing function of the vehicle so that the vehicle has the capability of forward and reverse movement as well as left, forward and right turning. This is accomplished according to the second embodiment by the use of two frequencies, two receiver circuits and two discs, one for steering and the other for axial movement. This is accomplished according to the third embodiment by use of a single disc which controls all of the turning and axial direction functions. In accordance with a fourth embodiment, axial movement is controlled by a front bumper switch which operates in response to a collision at the bumper to reverse vehicle direction until a further turning operation is conducted.

52 Claims, 17 Drawing Figures

SOUND CONTROLLED VEHICLE

BACKGROUND OF THE INVENTION

This application is a continuation-in-part of my prior application, Ser. No. 735,998, filed Oct. 27, 1976 now abandoned.

While prior art toy vehicles have been capable of sound actuated remote control and have been capable of providing start, stop and turning functions, they have been difficult to manufacture and economically unfeasible for the present day toy market. The industry has, for a long time, sought a cost effective toy vehicle capable of remote control and capable of turning functions as well as forward and reverse functions. This is accomplished in accordance with the present invention.

BRIEF DESCRIPTION OF THE INVENTION

Briefly, in accordance with one embodiment of the present invention, there is provided a remote sound or radio controlled vehicle having a pair of motors operated from a battery, one of the motors providing power to enable the vehicle to travel along an axial path and a second motor, responsive to a sound or radio frequency controlled electronic circuit, which is capable, upon sensing of each burst of remote sound or radio frequency, of causing the vehicle to move in a leftward direction, then a forward or axial direction, then a rightward direction and then back to a forward or axial direction, this sequence being continually repeated. This operation is provided by utilizing an electronic circuit which, in response to a signal of proper frequency, causes a motor to operate which revolves a cam having indentations therein. As the cam revolves, it acts upon switch blade elements which shut off the motor that provides axial movement to the vehicle and also acts to shut off the electronic circuit. Movement of this cam also provides movement of the forward wheels of the vehicle into a left, axial or forward position, as the case may be, the cam rotating 90° upon each sound burst received by the electronic circuit. In this way, the vehicle can be made to travel in an axial, leftward or rightward direction in sequential manner as indicated above by a remote frequency source. As an alternative, the motor providing axial movement is not a part of the control system and continually drives the vehicle in the forward direction.

In accordance with a second embodiment of the invention, the turning function is provided by means of an electrically conductive pattern which can be in the form of a conductive disc or a conductive pattern on a disc wherein the disc is driven by a remotely actuated motor to cause rotation of the disc and movement of the vehicle wheels to one of three possible positions, the motor being turned off by the disc and wipers thereon after each 90° rotation of the disc.

In accordance with a third embodiment of the invention, a printed circuit device in the form of a disc is used wherein wipers wipe along conductive areas on the printed circuit device as it rotates. The printed circuit device is formed in such a way that upon movement thereof 180°, the current to the motor which provides movement to the vehicle along the axis of the vehicle is reversed, thereby allowing the vehicle to travel in a reverse direction.

In accordance with a fourth embodiment of the invention, the functions of the first and second embodiments are combined by utilizing a single disc in conjunction with plural sets of contact elements.

In accordance with the fifth embodiment of the invention, the turning function is provided in accordance with any of the devices already described, the reversing function being actuated by a frontal collision of the vehicle wherein a switch element in the form of a bumper is moved by the collision to reverse the position of contacts on a printed circuit board and thereby reverse the direction of currnt flow through the motor providing axial movement. This reverse movement is changed to forward movement upon operation of a further vehicle turning function.

It is therefore an object of this invention to provide a remotely controlled toy vehicle which is capable of changing its direction of movement in response to a frontal collision.

It is a further object of this invention to provide a remotely controlled vehicle which is capable of changing to the left, axial and right turning directions in response to rotation of a disc having an electrically conductive pattern thereon, said rotation being provided by means of a remote signal.

It is a further object of this invention to provide a remotely controlled vehicle which is capable of forward and reverse movements as well as simultaneous left, axial and right turning by means of a remote set of frequencies.

It is a still further object of this invention to provide a patentably novel electro-mechanical system for turning of vehicle wheels.

The above objects and still further objects of the invention will immediately become apparent to those skilled in the arts after consideration of the following preferred embodiments of the invention which are provided by way of example and not by way of limitation wherein:

BRIEF DESCRIPTION OF THE DRAWINGS

FIG. 8*a* is a further embodiment of the electric circuit to be used in combination with the circuit of FIG. 8*b* to provide turning as well as independent forward and reverse operation;

DESCRIPTION OF PREFERRED EMBODIMENTS

Figure 1:
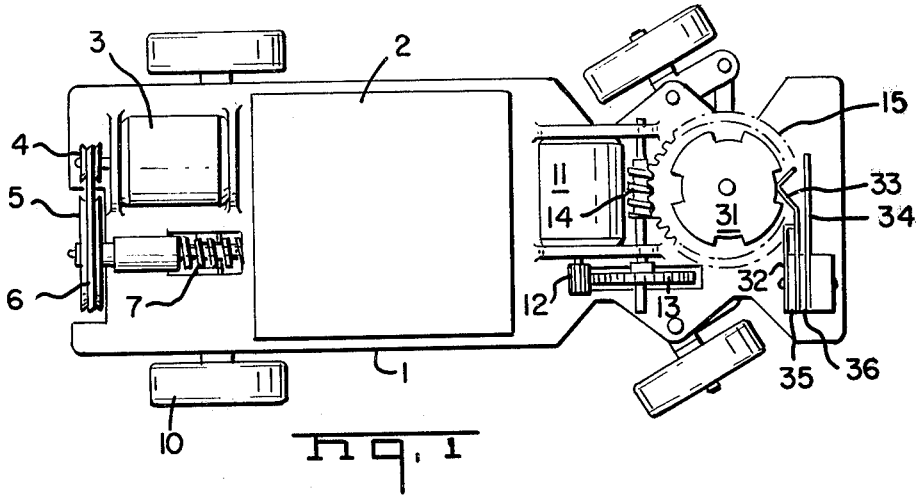
FIG. 1 is a top view of a sound controlled toy vehicle vehicle in accordance with the present invention.
Figure 2:
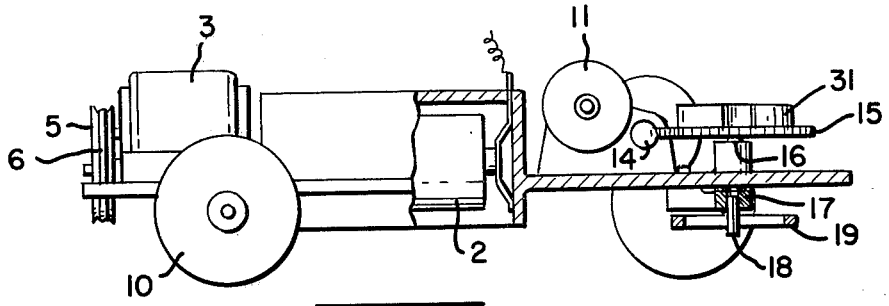
FIG. 2 is a view taken along the line 2—2 of FIG. 3.
Figure 3:
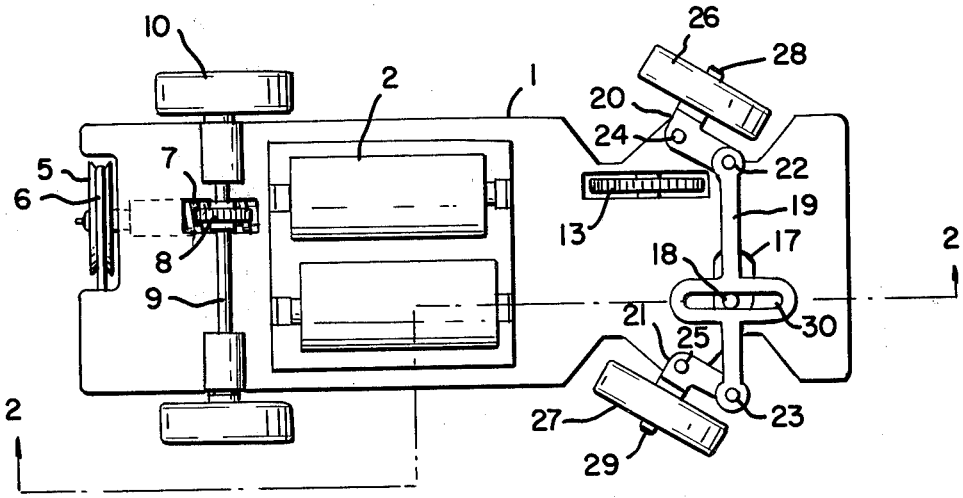
FIG. 3 is a bottom view of a sound controlled toy vehicle in accordance with the present invention.

Referring now to FIGS. 1 to 3, there is shown a vehicle chassis 1 having a battery 2 in the center portion thereof. At the rear of the vehicle is the vehicle axial drive mechanism which comprises the drive motor 3 having a pulley 4 mounted on the shaft of the motor 3 and driving pulley 5 by means of a belt 6. The pulley 5 drives the worm gear 7 (FIG. 1) which is meshed with the output gear 8 (FIG. 3) to provide rotation to the wheels 10 via the rear wheel shaft 9. The output gear 8 is keyed to the rear wheel shaft 9 to provide such rotation. Worm gear 7, output gear 8 and pulleys 4 and 5 can be eliminated and replaced by a direct friction drive between the motor shaft and the rear wheel 10.

The forward end of the vehicle of FIGS. 1 to 3 includes the steering mechanism which includes the steering motor 11 which is also operated from the battery 2 and which has a pinion gear 12 positioned on the shaft of the motor 11, the pinion gear driving a spur gear 13 which in turn drives a worm gear 14. The worm gear 14 drives the output gear 15 which has a central shaft 16 integral therewith and rotatably journaled in the chassis 1 (not shown). The shaft 16 has affixed to one side thereof the crank 17 as shown in FIG. 2, the crank also being clearly shown in FIG. 3. A crank pin 18 is secured to the crank 17 and engages the slot 30 in a link 19 best shown in FIG. 3. The opposite ends of the link 19 are pivotally affixed to the steering arms 20 and 21 by pins 22 and 23. The steering arms 20 and 21 are pivotally mounted on the chassis 1 by the pins 24 and 25 and the front wheels 26 and 27 are rotatably mounted to the shafts 28 and 29 which are affixed to the steering arms.

It can thus be seen that a 360° rotation of the crank pin in the slot 30 will steer the vehicle through the sequence of axial, right, axial and left and then again axial, the axial direction being forward or reverse along the axis of the vehicle.

Figure 4:
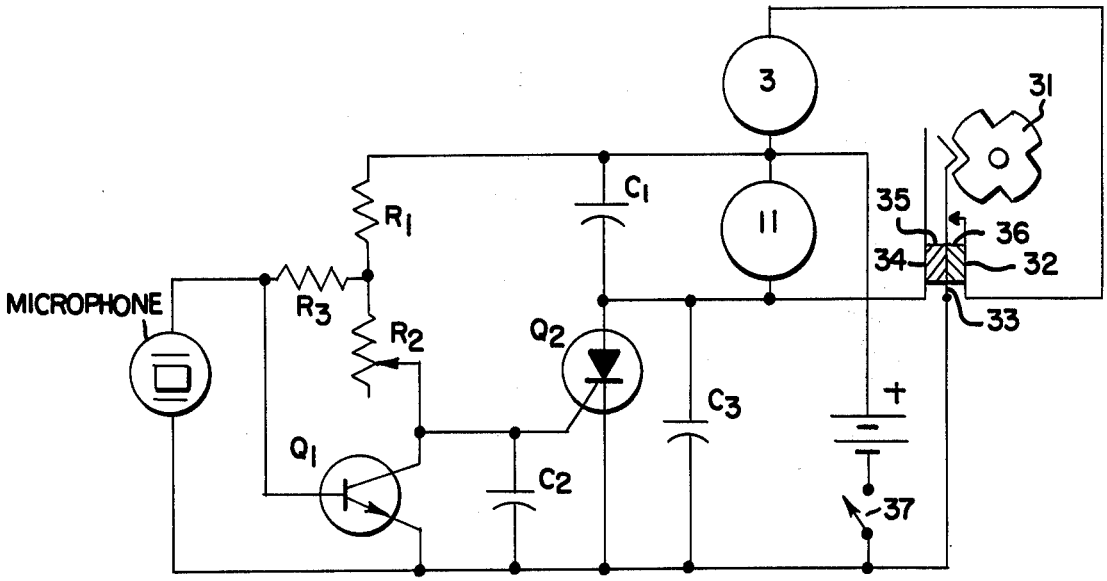
FIG. 4 is an electronic circuit for controlling the motors 3 and 11 of FIGS. 1–3.

The motor and gearing mechanism for changing the direction of the wheels 26 and 27 is controlled by means of the cam 31 which is affixed to the gear 15 and acts upon the switch blades 32, 33 and 34 (FIGS. 1 and 4) which are insulated from each other by the insulators 35 and 36, said assembly constituting a three bladed switch affixed to the chassis 1 as shown in FIGS. 1 and 4. The cam 31 is shown in a rest position and the blades 32 and 33 are in contact, completing the circuit to the drive motor 3 as shown in FIGS. 1 and 4 so that the vehicle is proceeding in either a straight, full left or full right direction.

A signal transmitted from a remote location of a frequency that can be picked up by the microphone of FIG. 4 will, for reasons to be explained hereinbelow, cause current to flow to and rotate the shaft of the steering motor 11 and thereby rotate the cam 31 by rotation of gears 12, 13, 14 and 15, thereby causing the blades 32 and 33 to separate due to the leftward movement of the blade 33 as shown in FIG. 4 and will also cause blades 33 and 34 to contact each other. Thus, the drive motor 3 is stopped while the contacting blades 33 and 34 keep the steering motor 11 running while simultaneously short circuiting the anode and cathode of the SCR Q1. When cam 31 has rotated 90°, the blade 33 falls into a subsequent notch in the cam 31 and blades 33 and 34 are separated as the blades 32 and 33 make contact. Now the steering motor 11 has stopped and, as drive motor 3 resumes operation, the circuit is ready for the next remote command signal.

In this manner, a vehicle proceeding on a stright course will respond to a signal of proper frequency by stopping and turning its front wheels to a new direction, then resuming movement in that new direction until another sharp audible sound will cause the vehicle to stop, steer to a straight ahead direction and resume movement in that direction.

Figure 5:
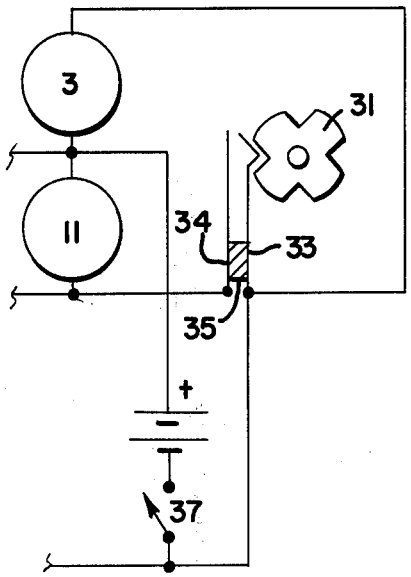
FIG. 5 is a second embodiment of the electronic circuit in accordance with the present invention.

If desired, the drive motor 3 can continue to run while the steering motor 11 operates. Thus, the toy will be driven continuously while it steers. This is accomplished by the embodiment of the circuit as shown in FIG. 5. In the FIG. 5 embodiment, blade 32 has been removed and the wire from drive motor 3 is connected directly to the negative battery terminal and will run continuously when the main switch 37 is closed.

Figure 6:
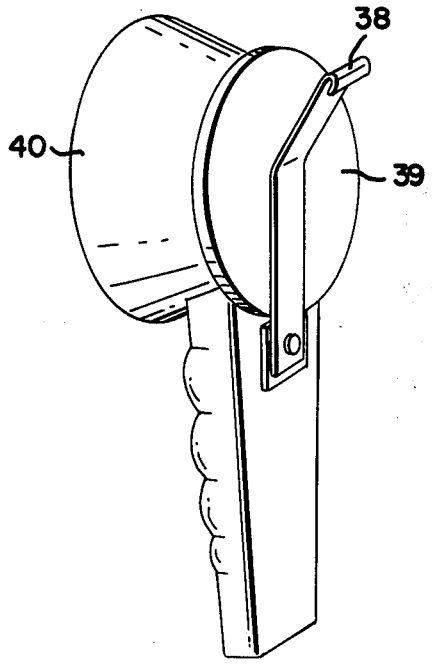
FIG. 6 is a device capable of providing a sound frequency from a remote location capable of commencing operation of the turning electronic circuit of FIGS. 4 and 5.

As stated previously, a proper frequency signal may be generated in the audible sonic range by clapping hands or a single hand held device as shown in FIG. 6 may be used. In the device of FIG. 6 a sound is generated by pulling back on the flat spring 38 and releasing it to strike the diaphragm 39. The cup or cone 40 will serve to direct the sound toward the vehicle. Of course, the device of FIG. 6 is designed to provide an audible signal in the frequency range to which the microphone of FIG. 4 is responsive so that the circuit will operate properly. It should be understood that other devices can be used which produce sonic signals, supersonic or non-audible sound waves, such as appropriate well known dog calling whistles or radio frequencies, the only additional requirement being that the microphone or other appropriate receiving device be capable of receiving and operating with the remote transmitted sound frequency signal.

Referring now to FIG. 4 and its operation, power is applied by closing switch 37. The switch actuated by cam 31 is normally positioned as shown in FIGS. 1, 4 and 5, therefore drive motor 3 is running. This causes the vehicle to move in an axial direction, assuming that the wheels are initially positioned for forward movement. A signal of appropriate frequency and intensity is now provided. This is picked up by the microphone as shown in FIG. 4, the microphone preferably being a crystal microphone (as stated above, other receiving devices can be used, which converts a sonic signal to an electrical signal) which is amplified by transistor Q1 and applied to the gate of the SCR or silicon controlled rectifier Q2. This turns on the SCR and causes current to pass through and operate the steering motor 11 from the battery 2. This also causes discharge of the previously charged capacitor C3. The motor 11 drives the steering mechanism and rotates cam 31 as described hereinabove to cause blades 33 and 34 to contact each other. This causes a short circuit to be provided between the anode and cathode of the SCR, thereby rendering it non-conductive while continuing to apply battery voltage to motor 11 via blades 33 and 34 until cam 31 allows blades 33 and 34 to separate by having blades 33 fall into the next notch therein, thereby rotating wheels 26 and 27. Motor 11 now comes to a stop and remains stopped until the SCR is triggered by the next sound frequency signal. Capacitor C3 is in a discharged state before blades 33 and 34 are separated and recharges to the full battery voltage as motor 11 coasts to a stop. By virture of this discharged state and the subsequent charging, capacitor C3 acts to suppress the arc that would be created by the separation of blades 33 and 34. Thus, capacitor C3 eliminates induced voltage transients in the circuit and prevents spurious triggering of the SCR. Capacitor C3 also acts as a filter across the SCR to limit the rate of voltage application to the SCR, said rate, if excessive, causing self-triggering of the SCR.

Figure 7:
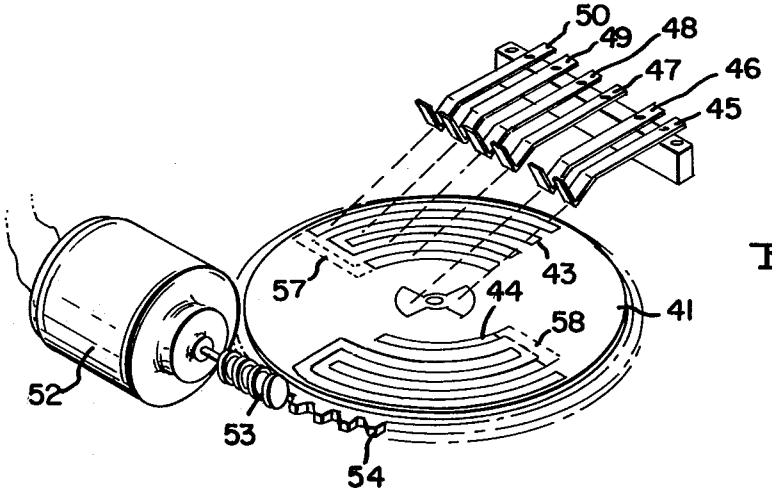
FIG. 7 is an embodiment of a switch structure with associated contact elements.
Figure 8A:
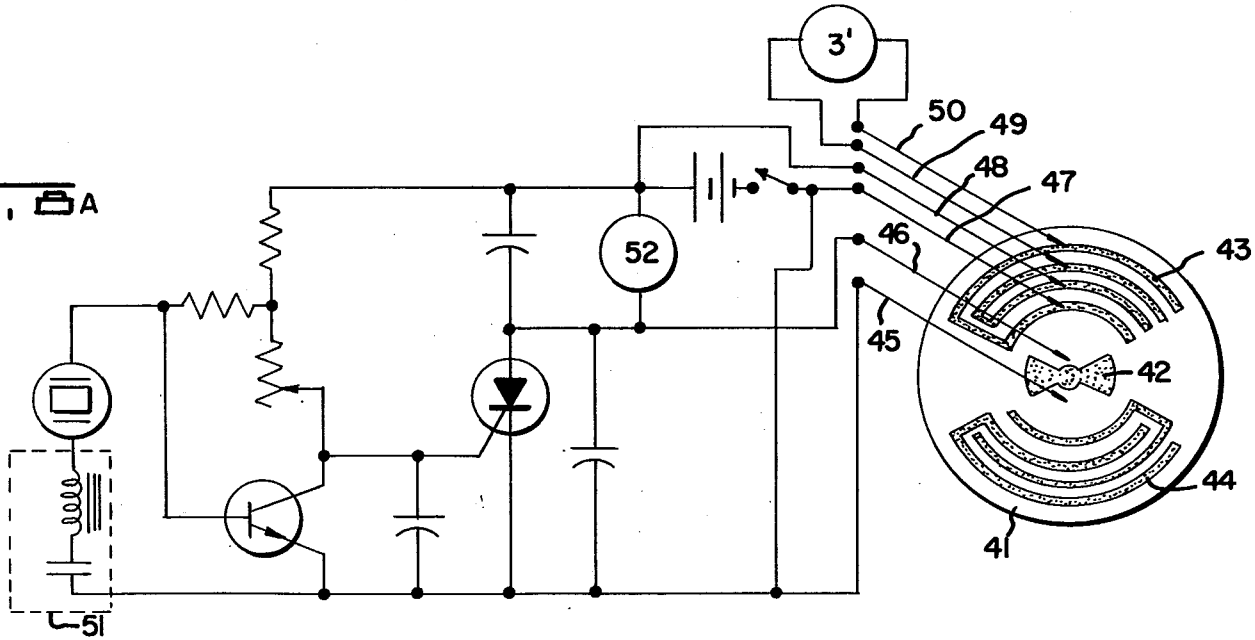
FIG. 8*a* is an embodiment of an electronic circuit for providing forward and reverse operation to a sound controlled toy vehicle utilizing the structure of FIG. 7.

Referring now to FIGS. 7 and 8*a*, there is shown another embodiment of the invention. In this embodiment, the two motor system can be used to cause a reversal of direction. In accordance with this embodiment, a printed circuit disc 41 is provided having etched thereon the three conductive patterns noted as 42, 43 and 44. It should be understood that though a printed circuit is shown, any other type of device such as conductive metal stampings affixed to a non-conductive disc, etc., can be used so long as they provide the same function. As described above, a sound frequency command will actuate motor 52 and rotate disc 41 through the reduction gears composed of worm gear 53 and output gear 54. The disc 41 is secured to the output gear 54 which may be rotatably journalled anywhere on the vehicle chassis, since it is not coupled to the steering mechanism. Blades 45 and 45 lie in the turning path of the conductive pattern 42. It is apparent that in each 180° of the rotation of disc 41, the SCR will be short circuited by the pattern 42 and then reset. The blades 47, 48 and 49 and 50 lie in the turning path of the conductive patterns 43 and 44 with each 180° rotation of disc 41. Such 180° rotation will alternately connect and reverse the connection of drive motor 3' to the positive and negative terminals of the battery. Thus, with each sound frequency command, the vehicle can be reversed in direction.

Figure 8B:
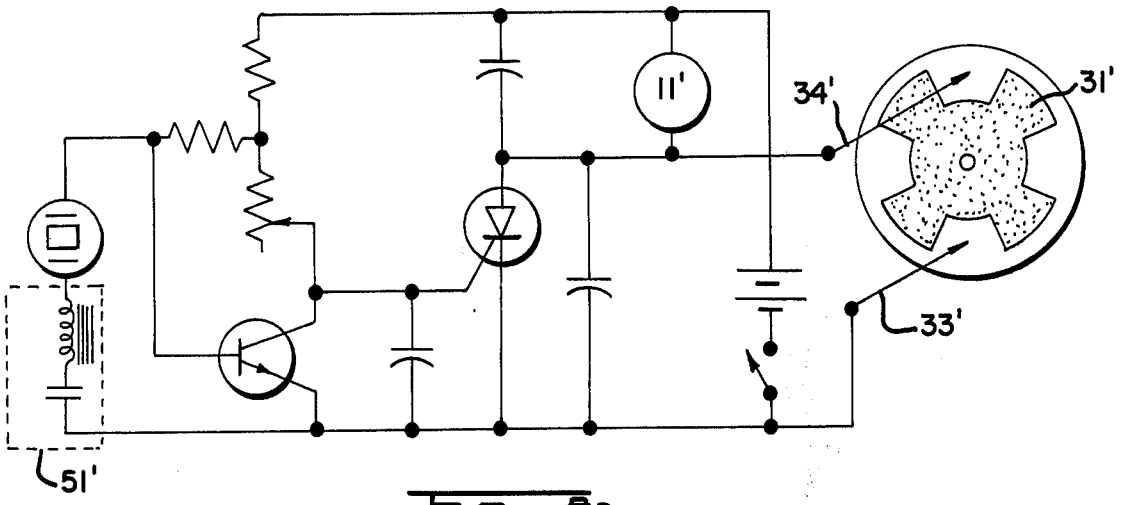

It is apparent that a toy may combine the systems for reversal shown in FIG. 8*a* with a system for steering as shown in FIG. 5. This embodiment is shown in the combination of FIGS. 8*a* and 8*b*. In FIG. 8*b* the cam 31 of FIG. 5 is replaced by a printed circuit disc 31', which is affixed to the output gear 15 and has etched thereon the conductive pattern shown. The blades 33' and 34' lie in the turning path of the conductive pattern 31' and hence will function in the same manner as cam 31 with blades 33 and 34 in FIG. 5. Since the electronic circuits of FIGS. 8*a* and 8*b* are sensitive to different sonic frequencies, a child may both steer and reverse the vehicle at will by generating the appropriate frequency. This can be accomplished by use of two signals or sonic generators that generate different frequencies and two circuits, each sensitive to different frequencies by virtue of frequency filters 51 and 51' shown in FIGS. 8*a* and 8*b*.

It should be understood that in FIG. 7, the connecting conductors 57 and 58 of the patterns 43 and 44 are shown dotted. This is to indicate that they may be on the underside of disc 41 with connection through aperture in the disc to prevent the momentary short circuiting of the batteries as the contacts 47, 48 pass over these connectors.

Figure 9:
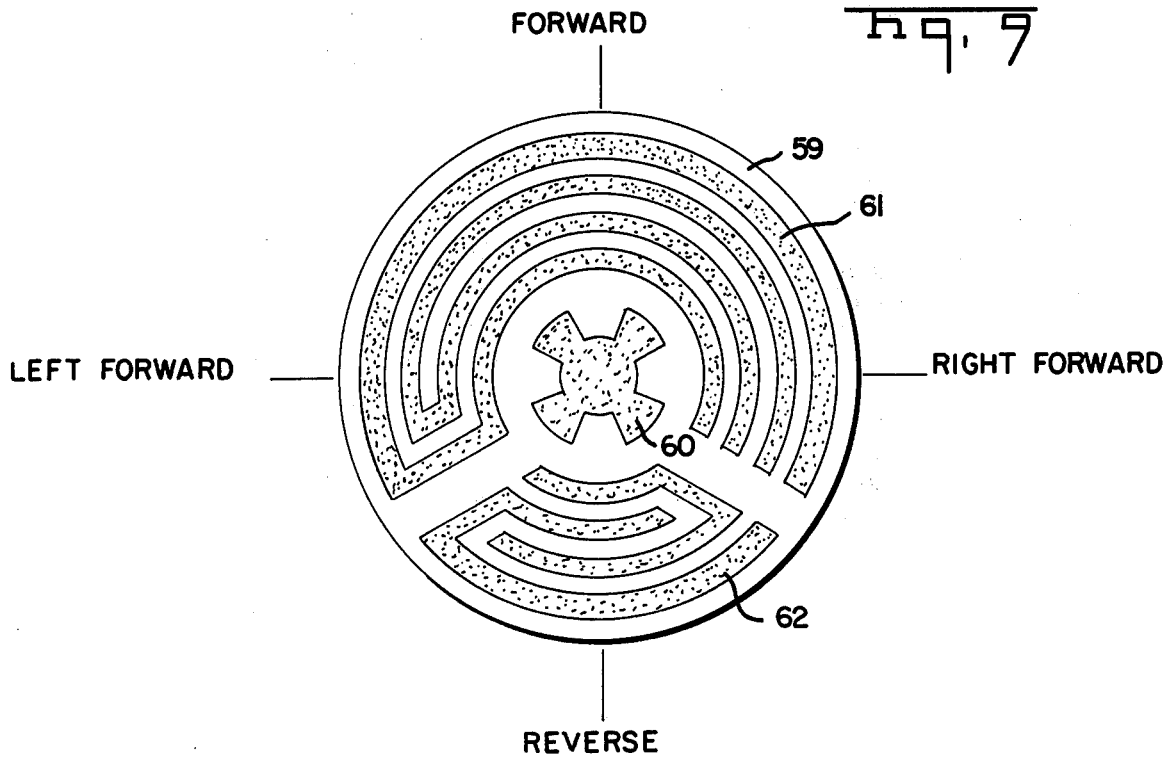
FIG. 9 is an embodiment of the switch structure shown in FIG. 7 for use in the circuit of FIG. 8*a* to provide sequential right, left, forward and reverse operation without addition of the circuit of FIG. 8*b*.

Sequential steering as well as reversal may be accomplished by replacing the printed circuit disc 41 in FIG. 8*a* with the printed circuit disc 59 shown in FIG. 9. Disc 59 is affixed to the output gear 15 and is therefore coupled to the steering mechanism in the same manner as cam 31 in FIGS. 1, 2 and 3. It is apparent that printed circuit disc 59 is a modification of printed circuit disc 41 in combination with printed circuit disc 31'. The conductive patterns 61 and 62 perform the same electrical reversing functions as conductive patterns 43 and 44 or disc 41, but conductive pattern 61, which determines the forward movement of the vehicle has been extended to cover a sector of approximately 240°. Conductive pattern 60 is the same as conductive pattern 31' in FIG. 8*b* and serves the same function. Therefore, with each sound frequency signal, the disc 61 will rotate 90° and move the vehicle through a sequence of axial forward, left forward, axial reverse, right forward, and then axial forward again.

The afore described reversing systems have some disadvantages. In the embodiment of FIG. 9 it is apparent that when the vehicle is turning to the right, the operator must cycle the steering mechanism through forward and left before the vehicle can be reversed.

In the combination embodiment using two different frequencies, the vehicle can be reversed at will, but this requires nearly doubling the control system, and the cost is objectionable.

Accordingly, by means of the embodiment of FIGS. 10 to 13, a system for reversing the vehicle when it strikes a wall or other obstacle, and then causing it to go forward again, at will, by a sonic signal operating the steering mechanism is provided.

Figure 10:
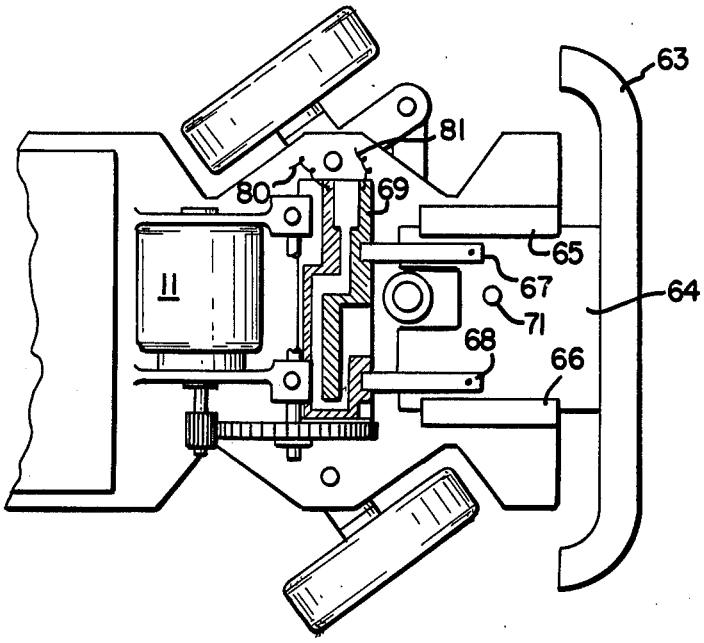
FIG. 10 is a top view with the worm gear 15 removed of the forward end of the vehicle in accordance with a still further embodiment of the invention to provide reversal upon collision.
Figure 11:
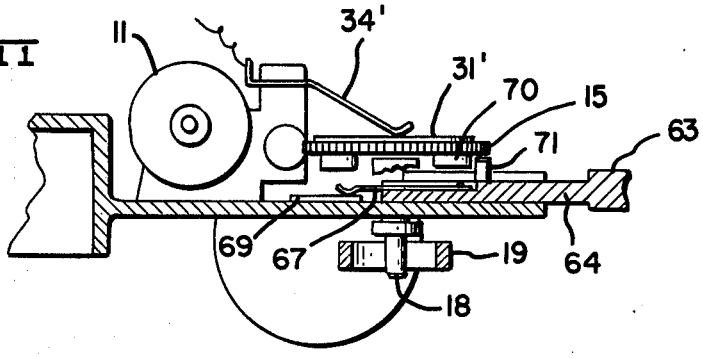
FIG. 11 is a partial side view as in FIG. 10 with the worm gear 15 in place.
Figure 12A:
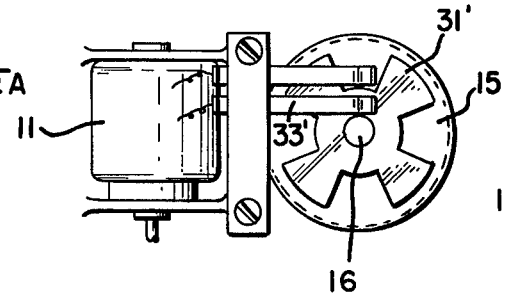
FIG. 12*a* is a top view of the worm gear and rotary steering switch of FIGS. 10 and 11.
Figure 12B:
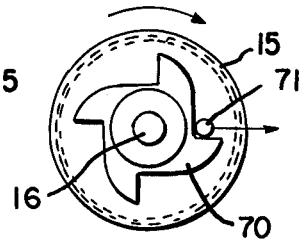
FIG. 12*b* is a bottom view as in FIG. 12*a;*
Figure 13:
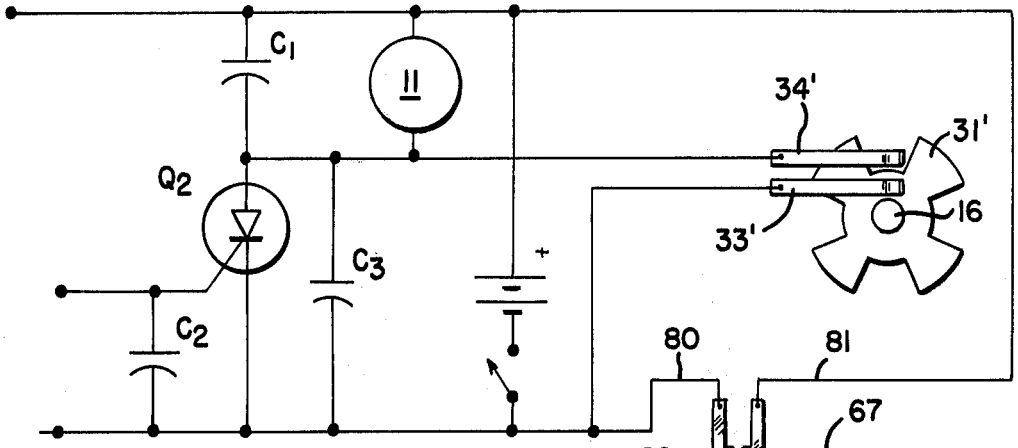
FIG. 13 is a partial electrical schematic diagram in accordance with the embodiment of FIGS. 10 to 12.

Referring now to FIGS. 10 to 12, there is shown a vehicle as in the prior embodiments with the addition of the bumper 63, affixed to a slide 64, said slide being constrained to move axially between guides 65 and 66. Guides 65 and 66 form "T" slots that prevent upward as well as non-axial movement of the slide. Affixed to the slide 64 are two contacts 67 and 68, said contacts pressing upon the small printed circuit board 69. These contacts and printed circuit boards are also shown in the circuit diagram in FIG. 13.

The printed circuit board 69 is connected to the battery via leads 80 and 81 while the slide contacts 67 and 68 are connected to the rear driving motor 3. In the normal or forward position, the slide contacts 67 and 68 are in contact with the printed circuit portions 84 and 85. It is apparent that when the bumper 63 strikes an obstruction, the slide contacts 67 and 68 are moved inwardly across the printed circuit board 69, and the contacts 67 and 68 will be positioned on portions 82 and 83 of the printed circuit 69 so that the polarity to the motor leads is reversed, thus reversing the vehicle. The slide contacts 67 and 68 are returned to the normal or forward position by the action of cam 70 against the cam follower 71 as described hereinbelow.

Affixed to the underside of the worm gear 15 is a cam 70 having four lobes (see FIG. 12*b*), said lobes being so oriented with the rotary switch 31' that when the steering mechanism is at rest, the cam follower 71 is opposite a valley in the cam. Thus, when the vehicle strikes an obstacle, the cam follower 71 moves into a depression in the cam and the vehicle reverses. Operation of the steering mechanism by a sound signal will rotate the cam 70 by 90°, thus turning the front wheels while simultaneously returning the slide 64 to its outward position with contacts 67 and 68 on portions 84 and 85 of printed circuit 69, thereby again reversing the direction of the vehicle.

In this manner the vehicle striking of an obstacle will cause reversal of its direction and cause it to continue in the rearward direction until a sonic signal actuates the steering mechanism to turn cam 70 and push out cam follower 71, again reversing the vehicle. Thus the vehicle will simultaneously move forward and turn away from the obstruction in a seemingly magical manner.

Figure 15:
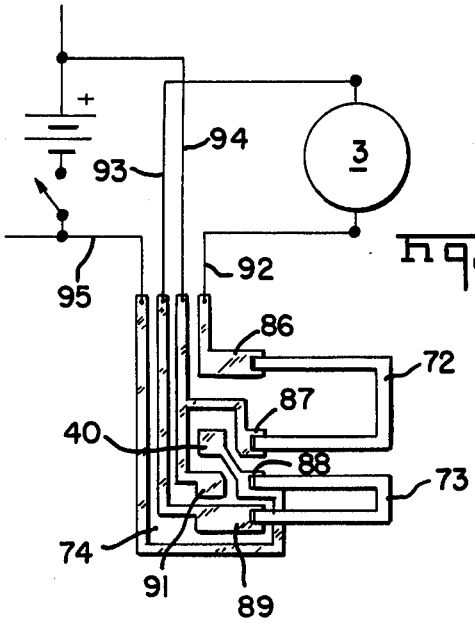
FIG. 15 is a partial electric circuit diagram of the embodiment of FIG. 14.
Figure 14:
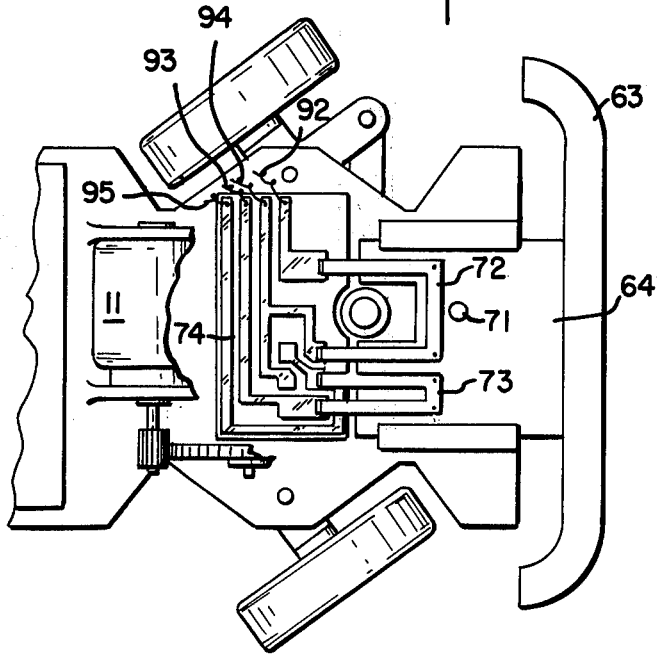
FIG. 14 is a top view of the forward end of the vehicle in accordance with a sixth embodiment of the invention to provide reversal upon collision.

FIG. 14 is another embodiment of the invention that eliminates the need for moving wires. In this embodiment, two U-shaped contacts 72 and 73 traverse the printed circuit board 74 which replaces the circuit board 69 of the prior embodiment 74. The printed circuit board and contacts are also shown in the partial electrical schematic diagram of FIG. 15. Here, too, it is apparent that, as the sliding contacts move inward from portions 86, 87, 88 and 89 to portions 86, 90, 91 and 89, the polarity of the motor leads 92 and 93 is reversed. Leads 94 and 95 go to the battery. Thus, again the vehicle will reverse when striking an obstruction and then, in reacting to a sonic signal, move forward as it turns away from the obstruction.

While the preferred embodiments utilize sound frequencies, it should be understood that any receivable radiation can be used, such as radio frequency, light frequency, etc. Accordingly, such control signals are included herein and can be substituted for one or more sound control devices in any combination.

Though the invention has been described with respect to specific preferred embodiments thereof, many variations and modifications will immediately become apparent to those skilled in the art. It is therefore the intention that the appended claims be interpreted as broadly as possible in view of the prior art to include all such variations and modifications.

What is claimed is:

1. A remotely controlled toy having plural support elements which comprises in combination, (a) means defining a predetermined electrically conductive pattern, (b) contact means contacting said pattern, (c) means responsive to a signal in a predetermined frequency band for rotating said means defining, and (d) control means responsive to rotation of said means defining and coupled to said contact means for controlling the direction of travel of said toy.

2. A toy as set forth in claim 1 wherein said support elements are wheels.

3. A toy as set forth in claim 2 wherein said means defining includes a plurality of electrically conductive patterns thereon along concentric circles, each of said contact means contacting one of said patterns.

4. A toy as set forth in claim 2 wherein said control means includes motor means controlled by rotation of said means defining for controlling the position of at least one of said wheels.

5. A toy as set forth in claim 3 wherein said control means includes motor means controlled by rotation of said means defining for controlling the position of at least some of said wheels.

6. A toy as set forth in claim 2 wherein said control means includes motor means controlled by rotation of said means defining for controlling the direction of rotation of at least some of said wheels.

7. A toy as set forth in claim 3 wherein said control means includes motor means controlled by rotation of said means defining for controlling the direction of rotation of at least some of said wheels.

8. A toy as set forth in claim 4 wherein said means defining comprises two independently rotatable means defining, and wherein said motor control means further includes additional motor means controlled by rotation of the other of said means defining for controlling the direction of rotation of the others of said wheels.

9. A toy as set forth in claim 5 wherein said means defining comprises two independently rotatable means defining, and wherein said motor control means further includes additional motor means controlled by rotation of the other of said means defining for controlling the direction of rotation of the others of said wheels.

10. A toy as set forth in claim 2 wherein said control means includes motor means controlled by rotation of said means defining for controlling the position of at least some of said wheels and for controlling the direction of rotation of the other of said wheels.

11. A toy as set forth in claim 3 wherein said control means includes motor means controlled by rotation of said means defining for controlling the position of at least one of said wheels and for controlling the direction of rotation of the other of said wheels.

12. A toy as set forth in claim 10 wherein said means defining is a single disc and said motor means comprises a pair of motors, each selectively controlled by rotation of said disc, one of said motors controlling the position of at least one of said wheels and the other motor controlling the direction of rotation of the other of said wheels.

13. A toy as set forth in claim 11 wherein said means defining means is a single disc and said motor means comprises a pair of motors, each selectively controlled by rotation of said disc, one of said motors controlling the position of at least one of said wheels and the other motor controlling the direction of rotation of the other of said wheels.

14. A toy as set forth in claim 1 wherein said control means includes an SCR having an anode and a cathode and a capacitor across said anode and cathode and wherein said contact means is connected across said anode and cathode.

15. A toy as set forth in claim 2 where in said control means includes an SCR having an anode and a cathode and a capacitor across said anode and cathode and wherein said contact means is connected across said anode and cathode.

16. A toy having plural support elements which comprises, in combination, (a) a chassis, (b) a motor mounted on said chassis, (c) driving means controlled by said motor, (d) positioning means driven by said driving means for positioning said support elements, and (e) motor control means responsive to a predetermined movement of said positioning means for controlling operation of said motor.

17. A toy as set forth in claim 16 wherein said support elements are wheels.

18. A toy as set forth in claim 17 wherein said motor control means includes a plural notched cam means.

19. A toy as set forth in claim 18 further including switch means controlled by said cam for controlling operation of said motor.

20. A toy as set forth in claim 17 wherein said motor control means includes a disc having plural electrically conductive patterns thereon and contact means coupled to said motor and said patterns.

21. A toy as set forth in claim 17 wherein said positioning means includes a shaft, a crank, link means driven in reciprocating motion by said crank and centrally pivoted linkage means coupled to said wheels and said link means for controlling the position of said wheels.

22. A toy as set forth in claim 18 wherein said positioning means includes a shaft, a crank, link means driven in reciprocating motion by said crank and centrally pivoted linkage means coupled to said wheels and said link means for controlling the position of said wheels.

23. A toy as set forth in claim 19 wherein said positioning means includes a shaft, a crank, link means driven in reciprocating motion by said crank and centrally pivoted linkage means coupled to said wheels and said link means for controlling the position of said wheels.

24. A toy as set forth in claim 20 wherein said positioning means includes a shaft, a crank, link means driven in reciprocating motion by said crank and centrally pivoted linkage means coupled to said wheels and said link means for controlling the position of said wheels.

25. A toy as set forth in claim 17, further including means responsive to a remote signal for commencing operation of said motor.

26. A toy as set forth in claim 23 further including means responsive to a remote signal for commencing operation of said motor.

27. A toy as set forth in claim 24 further including means responsive to a remote signal for commencing operation of said motor.

28. A toy vehicle having support means and comprising, in combination, (a) a chassis,
(b) a motor mounted on said chassis,
(c) driving means driven by said motor and having a last element,
(d) means defining a predetermined electrically conductive pattern driven by said last element, and
(e) linkage means coupled to said support means and selectively positioned by said last element.

29. A toy as set forth in claim 27 wherein said support means are wheels.

30. A toy as set forth in claim 29 further including means controlled by said means defining for controlling operation of said motor.

31. A toy as set forth in claim 29 further including signal responsive means for initiating operation of said motor.

32. A toy as set forth in claim 30, further including signal responsive means for initiating operation of said motor.

33. A toy as set forth in claim 13 wherein said control means includes an SCR having an anode and a cathode and a capacitor across said anode and cathode and wherein said contact means is connected across said anode and cathode.

34. A toy as set forth in claim 16 wherein said control means includes an SCR having an anode and a cathode and a capacitor across said anode and cathode and wherein said motor control means includes means to short circuit said anode and cathode.

35. A toy as set forth in claim 17 wherein said control means includes an SCR having an anode and a cathode and a capacitor across said anode and cathode and wherein said motor control means includes means to short circuit said anode and cathode.

36. A toy as set forth in claim 19 wherein said control means includes an SCR having an anode and a cathode and a capacitor across said anode and cathode and wherein said motor control means includes means to short circuit said anode and cathode.

37. A toy as set forth in claim 21 wherein said control means includes an SCR having an anode and a cathode and a capacitor across said anode and cathode and wherein said motor control means includes means to short circuit said anode and cathode.

38. A remotely controlled toy which comprises, in combination:

(a) a chassis,
(b) front wheel means rotatably mounted on said chassis,
(c) rear wheel means rotatably mounted on said chassis,
(d) propulsion means coupled to one of said front and rear wheel means for propelling said one of said front and rear wheel means,
(e) the other of said front and rear wheel means including a pair of wheels and a wheel shaft for each wheel, each said wheel being rotatably mounted on a said wheel shaft,
(f) positioning means secured to said pair of wheels including a steering motor, gear means driven by said steering motor, an output gear driven by said gear means, said output gear having a control shaft rotatably journalled in said chassis, a crank affixed to said shaft and rotatable therewith, a crank pin secured to said crank and offset from said shaft, a link including a slot and a pair of link arms extending outwardly from opposite sides of said slot, said crank pin engaging said slot, a pair of steering arms pivotally affixed to said arms and pivotally mounted on said chassis, each said wheel shaft secured to each said steering arm, a disc mounted on and rotatable with said output gear, a pattern of electrically conductive regions and electrically non-conductive regions on said disc, plural electric contacts contacting predetermined different portions of said pattern for providing power to said steering motor and means mounted on said chassis responsive to said contacts and a remote control signal for energizing said steering motor.

39. A remotely controlled toy as set forth in claim 38 wherein said means responsive to a remote control signal includes an electronic circuit responsive to electrical signals from said contact means for further controlling energization of said steering motor.

40. A remotely controlled toy as set forth in claim 38 wherein said remote control signal is in the sound frequency range.

41. A remotely controlled toy as set forth in claim 39 wherein said remote control signal is in the sound frequency range.

42. A remotely controlled toy as set forth in claim 39 wherein predetermined ones of said contacts are coupled to said propulsion means, said conductive regions associated with said predetermined ones of said contacts causing current through said contacts to reverse in direction responsive to predetermined rotary positions of said disc to cause reversal of direction of said propulsion means.

43. A remotely controlled toy as set forth in claim 40 wherein predetermined ones of said contacts are coupled to said propulsion means, said conductive regions associated with said predetermined ones of said contacts causing current through said contacts to reverse in direction responsive to predetermined rotary positions of said disc to cause reversal of direction of said propulsion means.

44. A remotely controlled toy as set forth in claim 41 wherein predetermined ones of said contacts are coupled to said propulsion means, said conductive regions associated with said predetermined ones of said contacts causing current through said contacts to reverse in direction responsive to predetermined rotary positions of said disc to cause reversal of direction of said propulsion means.

45. A remotely controlled toy as set forth in claim 38 wherein predetermined ones of said contacts are coupled to said propulsion means, said conductive regions associated with said predetermined ones of said contacts causing current through said contacts to reverse in direction responsive to predetermined rotary positions of said disc to cause reversal of direction of said propulsion means.

46. A toy having wheel means which comprises in combination, (a) a chassis, (b) a motor mounted on said chassis for driving said wheel means along an axial path in a first predetermined direction, (c) impact responsive switch means, mounted on said chassis and responsive to impact thereon for switching from a first condition to a second condition for reversing said direction of said wheel means, and (d) means in said toy responsive to a predetermined radiant energy signal for switching said switch means to said first condition for driving said wheel means along said first predetermined direction.

47. A toy as set forth in claim 46 further including a source of power for said motor, said impact responsive switch means including means to reverse the direction of power flow to said motor in response to impact thereon.

48. A toy as set forth in claim 46 wherein said impact responsive means includes bumper means slidable axially along said chassis, a pair of contact secured to said bumper means and movable therewith, a surface including an electrically conductive circuit pattern thereon, said contacts each contacting said pattern, whereby, in a first predetermined position of said contacts on said surface, said circuit pattern causes said motor to run in a first direction and, in a second predetermined position of said contacts on said surface, said circuit pattern causes said motor to turn in the opposite direction.

49. A toy as set forth in claim 48 wherein said means responsive in (d) includes a cam rotatable responsive to said further predetermined operation and a cam follower responsive to rotation of said cam to move said bumper means outwardly from said chassis whereby said contacts are placed in said first predetermined position.

50. A toy as set forth in claim 49 wherein said cam includes a plurality of lobes defining plural peaks and valleys, said cam follower being positioned in a said valley when said bumper slides inwardly into said chassis, said cam follower being at a peak after a said predetermined operation.

51. A toy as set forth in claim 49 wherein said means responsive in (d) further includes a disc carrying said cam and remote controlled means for rotating said disc.

52. A toy as set forth in claim 50 wherein said means responsive in (d) further includes a disc carrying said cam and remote controlled means for rotating said disc.

* * * * *